US011230021B2

(12) United States Patent
Iaccarino

(10) Patent No.: US 11,230,021 B2
(45) Date of Patent: Jan. 25, 2022

(54) COMB FOR A HAIR CLIPPER

(71) Applicant: KONINKLIJKE PHILIPS N.V., Eindhoven (NL)

(72) Inventor: Luca Iaccarino, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/969,580

(22) PCT Filed: Feb. 19, 2019

(86) PCT No.: PCT/EP2019/054012
§ 371 (c)(1),
(2) Date: Aug. 13, 2020

(87) PCT Pub. No.: WO2019/162239
PCT Pub. Date: Feb. 9, 2019

(65) Prior Publication Data

US 2021/0008740 A1 Jan. 14, 2021

(30) Foreign Application Priority Data

Feb. 20, 2018 (EP) ..... 18157650

(51) Int. Cl.
*B26B 19/20* (2006.01)
*B26B 19/38* (2006.01)
*B26B 19/06* (2006.01)

(52) U.S. Cl.
CPC ..... *B26B 19/20* (2013.01); *B26B 19/3813* (2013.01); *B26B 19/06* (2013.01); *B26B 19/3853* (2013.01)

(58) Field of Classification Search
CPC ... A45D 24/00; A45D 24/36; B26B 19/00–48
(Continued)

(56) References Cited

U.S. PATENT DOCUMENTS 1,908,385 A 5/1933 Wahl
4,557,050 A 12/1985 Haraguchi
(Continued)

FOREIGN PATENT DOCUMENTS

CN 203973585 12/2014
CN 104760063 7/2015
(Continued)

OTHER PUBLICATIONS

International Search Report and Written Opinion dated May 17, 2019 for International Application No. PCT/EP2019/054012 Filed Feb. 19, 2019.

*Primary Examiner* — Richard D Crosby, Jr.

(57) ABSTRACT

This application concerns a hair-thinning comb (200) comprising pairs of comb teeth. Each pair comprises a primary comb tooth (216) and an adjacent secondary comb tooth (217). A distal primary tip (218) of the primary comb tooth (216) extends longitudinally beyond a distal secondary tip (219) of the secondary comb tooth (217). A blocking channel (226) between roots of the primary and secondary comb teeth (216, 217) prevent hairs received therein from reaching a cutting element (106) of a hair clipper (100). There is also a cutting gap (225) separating adjacent pairs of comb teeth to permit hair to pass to a cutting element (106) clipper (100). The distal primary tips (218) separate hair in a first separation stage, and the distal secondary tips (219) separate hair between the blocking channel (226) and the cutting gap (225) in a second separation stage.

8 Claims, 5 Drawing Sheets

(58) Field of Classification Search
USPC ..... 30/233, 233.5, 194–210
See application file for complete search history.

(56) References Cited

U.S. PATENT DOCUMENTS

| | | | | |
|---|---|---|---|---|
| 5,050,305 | A * | 9/1991 | Baker | B26B 19/20 30/201 |
| 5,123,159 | A | 6/1992 | Kubo | |
| 5,237,750 | A | 8/1993 | Nakano | |
| 6,125,545 | A * | 10/2000 | Yamaguchi | B26B 19/20 30/233.5 |
| 6,618,948 | B2 * | 9/2003 | Lin | B26B 19/20 30/233.5 |
| 6,658,740 | B2 * | 12/2003 | Habben | B26B 19/06 30/210 |
| 7,536,789 | B2 * | 5/2009 | Michel | A45D 24/22 30/200 |
| 8,800,152 | B2 * | 8/2014 | Werner | B26B 19/20 30/200 |
| 8,844,142 | B2 * | 9/2014 | Kammer | B26B 19/3846 30/201 |
| 10,124,496 | B2 * | 11/2018 | Nab | B26B 19/3813 |
| 10,946,537 | B2 * | 3/2021 | Danmola | B26B 19/20 |
| 2004/0250428 | A1 * | 12/2004 | Melton | B26B 19/3813 30/200 |
| 2008/0005908 | A1 * | 1/2008 | Melton | B26B 19/20 30/233.5 |
| 2008/0184565 | A1 | 8/2008 | Zoot | |
| 2008/0289192 | A1 * | 11/2008 | Martelli | B26B 19/3813 30/233.5 |
| 2009/0113722 | A1 * | 5/2009 | Werner | B26B 19/3813 30/200 |
| 2009/0126201 | A1 * | 5/2009 | Melton | B26B 19/3846 30/208 |
| 2009/0241975 | A1 | 10/2009 | Nakakura | |
| 2011/0061243 | A1 * | 3/2011 | Smit | B26B 19/20 30/233.5 |
| 2011/0131790 | A1 * | 6/2011 | Chien | B26B 19/06 29/557 |
| 2012/0240415 | A1 * | 9/2012 | Tringali | B26B 19/3846 30/225 |
| 2014/0331504 | A1 * | 11/2014 | Michel | B26B 13/24 30/233.5 |
| 2015/0183118 | A1 * | 7/2015 | Roth | B26B 19/3846 132/200 |
| 2015/0202782 | A1 * | 7/2015 | Chien | B26B 19/06 30/210 |
| 2016/0101530 | A1 * | 4/2016 | Sablatschan | B26B 19/3893 30/208 |
| 2017/0266823 | A1 * | 9/2017 | Whittaker | B26B 19/20 |
| 2020/0238547 | A1 * | 7/2020 | Iaccarino | B26B 19/3826 |

FOREIGN PATENT DOCUMENTS

| | | | |
|---|---|---|---|
| EP | 2055449 | 5/2009 | |
| EP | 2062702 | 9/2011 | |
| EP | 2462831 | 6/2012 | |
| FR | 2812836 | 2/2002 | |
| FR | 2812836 A1 * | 2/2002 | B26B 19/22 |
| JP | 2005270193 | 10/2005 | |
| JP | 4225368 | 9/2008 | |
| JP | 2015128533 | 7/2015 | |
| WO | 200511929 | 2/2005 | |
| WO | 2008068952 | 6/2008 | |
| WO | 201356926 | 4/2013 | |

* cited by examiner

COMB FOR A HAIR CLIPPER

CROSS REFERENCE TO RELATED APPLICATIONS

This application is the U.S. National Phase application under 35 U.S.C. § 371 of International Application No. PCT/EP2019/054012 filed Feb. 19, 2019, published as WO 2019/162239 on Aug. 29, 2019, which claims the benefit of European Patent Application Number 18157650.5 filed Feb. 20, 2018. These applications are hereby incorporated by reference herein.

FIELD OF THE INVENTION

The present application concerns combs for hair clippers and hair clipper apparatus comprising combs.

BACKGROUND OF THE INVENTION

Hair clippers are used for trimming hair. The cutting element of a hair clipper usually comprises a pair of comb-like blades which rapidly slide back and forth relative to each other in order to cut hairs positioned between the teeth of the blades with a scissor-like action. Clippers enable large numbers of hairs to be cut in a single stroke.

In order to guide hairs to the cutting element, hair clippers are sometimes provided with a comb which lifts and guides hairs as the hair clipper is moved over the skin. A comb typically comprises a base which contacts the skin during a stroke of the clipper through the hair. Extending from the base are a plurality of comb teeth for guiding hairs to be cut to the cutting element and which can be used to provide a predetermined fixed spacing between the skin and the cutting element in order to define a remaining length of the hairs after cutting (i.e. a hair cutting length).

In some cases it may be desirable to thin the hair being cut by cutting some but not all of the hairs that fall between adjacent comb teeth. Accordingly, it is known to provide a comb having one or more blocking elements disposed between respective comb teeth for preventing the hairs falling on those blocking elements to be cut.

A problem with such combs, however, is their inability to adequately position and orient hairs away from the skin, and uniformly separate hairs to be cut and hairs to be blocked. This results in an inconsistent hair-thinning result. Accordingly, it would be desirable to provide a hair-thinning comb for a hair clipper which provides a consistent improved hair-thinning, amongst other things.

SUMMARY OF THE INVENTION

In a first aspect, there is provided a hair-thinning comb comprising:

a support body for attachment to a hair clipper;

a plurality of pairs of comb teeth in side-by-side relationship, wherein each pair of comb teeth comprises:

- a primary comb tooth having a longitudinal extent from a root proximal the support body to a distal primary tip;
- a secondary comb tooth adjacent to the primary comb tooth, and having a longitudinal extent from a root proximal the support body to a distal secondary tip;
- wherein the distal primary tip extends longitudinally beyond the distal secondary tip;

wherein there is a blocking portion between the roots of the primary and secondary comb teeth configured to prevent any hairs received in a blocking channel defined between the primary and secondary comb teeth from reaching a cutting element of the hair clipper; and wherein adjacent pairs of comb teeth are separated by a cutting gap to permit hair to pass through the gap to a cutting element of a hair clipper;

whereby in use the distal primary tips separate hair in a first separation stage, and the distal secondary tips separate hair received between the primary comb teeth between the blocking channel and the cutting gap in a second separation stage.

The terms proximal and distal are used herein to denote position relative the hair clipper when the comb is attached, with proximal denoting positions closer to the clipper, and distal denoting positions further away.

The technology described herein is concerned with a comb for separating hairs in two stages: a first separation stage in which hairs are separated upstream in a cutting direction by a set of primary comb teeth; and a second, downstream separation stage in which hairs received between the primary comb teeth are separated between a blocking channel and a cutting gap of the comb to provide a hair thinning effect in use.

In this way, hairs entering the comb between respective primary comb teeth will be guided, untangled and raised by the primary comb teeth such that hairs are brought more uniformly towards the point of separation between those to be cut and those to be blocked. Additionally, providing a blocking channel between the primary comb tooth and the secondary comb tooth will prevent hairs aligned with the blocking element from inadvertently slipping into the cutting gap and therefore being cut.

Thus the technology described herein results in an improved and more consistent thinning result for each stroke.

Furthermore, the secondary comb teeth will serve to further raise and untangle hairs before cutting, thereby improving the orientation of the hairs passing through to the cutting element and enabling a greater number of hairs to be cut at a predetermined hair cutting length determined by the geometry of the comb.

The primary comb tooth may extend longitudinally beyond the distal secondary tip in the longitudinal extent direction of the secondary comb tooth. The distal primary comb tooth, e.g. the distal primary tip thereof, may extend beyond the distal secondary tip in a direction normal to the skin surface, in use. The distal primary tip may extend longitudinally beyond the distal secondary tip such that the secondary comb tooth, e.g. the distal secondary tip, does not meet the skin surface, in use.

The blocking portion may comprise a hair-facing edge that defines the base of the blocking channel.

The root of the primary comb tooth may correspond to the hair-facing edge at the point closest to the primary comb tooth. That is, the primary comb tooth may extend from the hair-facing edge, in which case the root of the primary comb may be the junction between the hair-facing edge and the primary comb tooth.

Similarly, the root of the secondary comb tooth may correspond to the hair-facing edge at the point closest to the secondary comb tooth. That is, the secondary comb tooth may extend from the hair-facing edge, in which case the root of the secondary comb may be the junction between the hair-facing edge and the secondary comb tooth.

The longitudinal extent of the primary comb tooth may be greater than the longitudinal extent of the secondary comb tooth. In this way, the distal primary tips will extend beyond the distal secondary tips in arrangements where the roots of the first and second comb teeth are each at the same distance from a cutting edge of the cutting element.

The distal primary tip may extend longitudinally beyond the distal secondary tip by at least the longitudinal extent of the secondary comb tooth. The distal primary tip may extend longitudinally beyond the distal secondary tip by an amount in the range of approximately 1 to 12 times the longitudinal extent of the secondary comb tooth.

The longitudinal extent of the secondary comb tooth may be at least 0.5 mm in length.

The longitudinal extent of the secondary comb tooth may be in the range of approximately 1-6 times the pitch between the distal secondary tip and an adjacent primary comb tooth in a direction parallel with a lateral direction along which the pairs off comb teeth are spaced apart. This longitudinal extent effectively prevents hairs from slipping from the blocking portion into the cutting element.

The blocking portion may connect the roots of the primary comb tooth and the secondary comb tooth to define the blocking channel.

The blocking portion may be substantially downstream of the distal primary tips in the cutting direction. For example, the blocking portion may be closer to a cutting edge of the cutting element than the distal primary tips, in use.

The blocking portion may comprise a hair-facing edge that is parallel with a lateral direction along which the pairs of comb teeth are spaced apart. The primary comb tooth, the secondary comb tooth and the hair-facing edge may define an asymmetric U-shaped profile in cross-section. These features maximise the depth of the channel holding the hairs to be blocked, thereby securely retaining hairs that are not to be cut.

The primary comb tooth may provide, at least in part, a predetermined fixed spacing between a skin of a user and the cutting element in order to define a hair cutting length. That is, the primary comb teeth, e.g. and the support body, may support the cutting edge of the clipper in use at a fixed spacing from the skin. The fixed spacing may define the cutting length.

A pitch between the distal secondary tip and an adjacent primary comb tooth in a direction parallel with a lateral direction along which the pairs of comb teeth are spaced apart may be equal to: the width of an opening in the cutting element for receiving hairs to be cut; or the width separating adjacent guard teeth of the cutting element. A pitch between the distal secondary tip and an adjacent primary comb tooth in a direction parallel with a lateral direction along which the pars of comb teeth are spaced apart may be in the range of approximately 1-3 mm, e.g. approximately 1.8 mm.

These widths allow approximately half of the hairs entering the comb between respective pairs of comb teeth to be blocked/cut during a single stroke, thereby resulting in an even hair thinning effect across the pairs of comb teeth.

The adjacent primary comb tooth may be the primary comb tooth of the pair to which the secondary comb tooth belongs, or may be a primary comb tooth of an adjacent pair.

In a second aspect, there is provided a hair-thinning comb in accordance with the first aspect described herein and any optional features thereof.

In a third aspect, there is provided a hair clipper apparatus comprising a hair clipper having a housing and a cutting element; and a hair-thinning comb in accordance with any of the above aspects.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE FIGURES

Embodiments will now be described by way of example only, with reference to the drawings, in which.

DETAILED DESCRIPTION OF EMBODIMENTS

Figure 1:
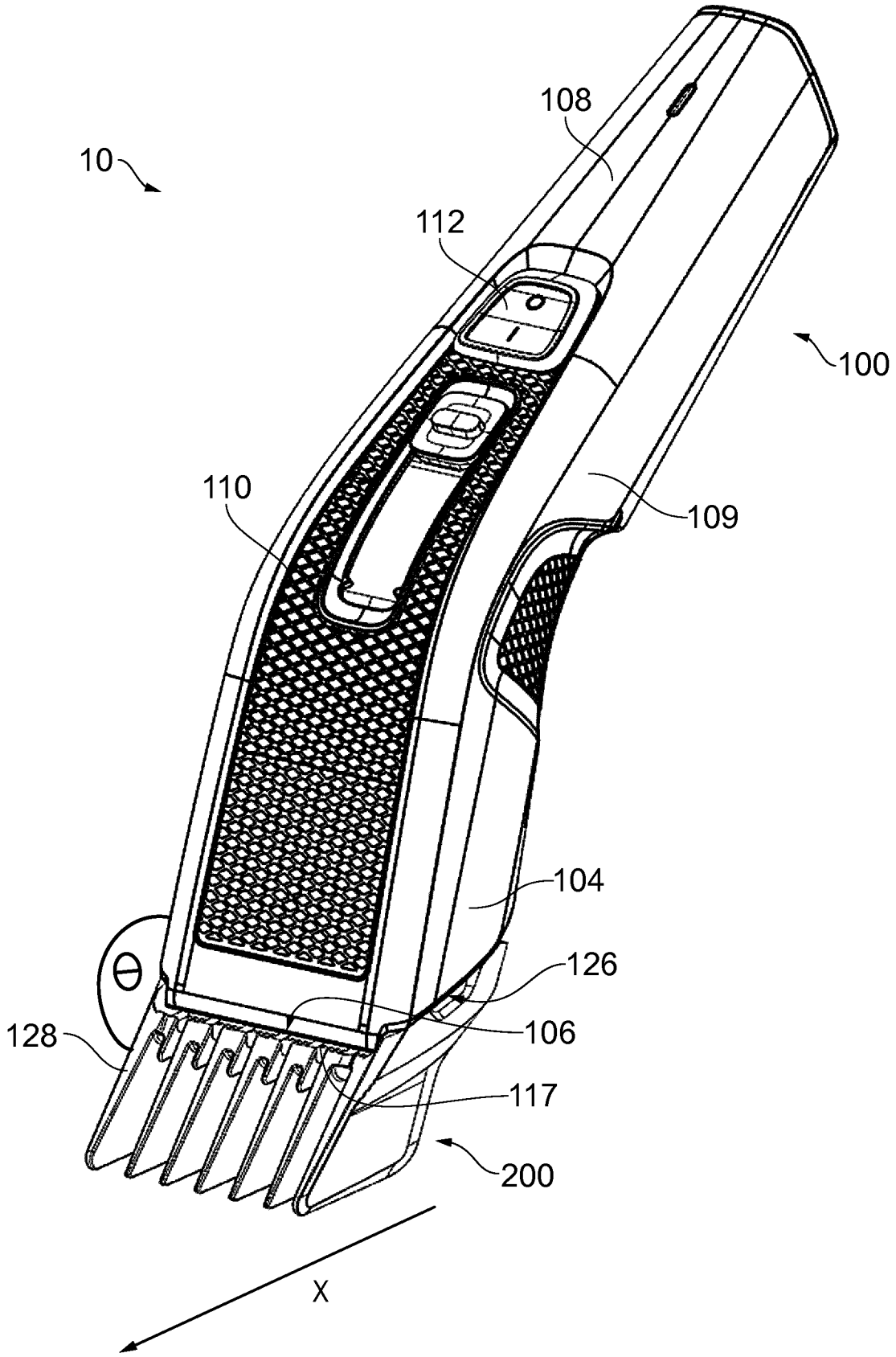
FIG. 1 is a perspective view of a hair clipper apparatus comprising a hair clipper and a comb.

Referring to FIGS. 1-4, there is generally shown an apparatus 10 comprising a hair clipper 100 and a comb 200.

The hair clipper 100 comprises an elongate grippable body having a cutting head 104 on which a cutting element 106 is attached and a handle portion 108 which generally extends away from the cutting head 104. The clipper body is generally formed by a housing 109 which forms the external surface of the clipper body.

The handle portion 108 is an elongate grippable portion by which a user can grip the clipper 100 with their hand during use. The handle portion 108 is partially covered with a rubberised or textured surface 110 to facilitate better gripping of the clipper 100 by a user, particularly when the handle portion 108 is wet. On a front face of the handle portion 108 a power button 112 is provided for powering the clipper 100 on/off.

The cutting head 104 is arranged at an end of the handle portion 108. The cutting head 104 comprises the cutting element 106 of the clipper 100. The cutting element 106 may comprise a first static blade and a second reciprocating blade. The blades combine to form a cutting edge 117. The reciprocating blade is reciprocated laterally relative to the static blade in a direction parallel to the cutting edge 117, such that hairs positioned between the blade teeth are cut with a scissor-like action as the blade teeth move past one another. The reciprocating blade may be moved using a motor which powers a reciprocating mechanism (not shown) attached to the blade. The motor may be powered by a rechargeable battery contained within the housing 109 of the clipper 100. The motor can be selectively turned on and off using the power switch 112.

The cutting edge 117 forms a front edge of the cutting head 104. A cutting direction x of the hair clipper 100 is normal to the cutting edge 117. It should be understood that in order for hairs to easily enter the gaps between the blade teeth, they must approach the cutting edge 117 from the front side of the cutting edge 117 along the cutting direction x. Therefore, the hair clipper 100 cuts hair most effectively when moved forwards in the cutting direction x shown in FIG. 1.

The external surface 126 of the cutting head 104 which is rearward of the cutting edge 117 in the cutting direction x faces the skin in use. In use, for a close shave without the comb 200 attached to the clipper 100, the skin-facing surface 126 is generally pressed lightly against the user's skin, and the clipper is slid along the user's skin in the cutting direction, such that the cutting edge 117 moves forward along the user's skin in the cutting direction x, to cut any hairs that it encounters.

Figure 2:
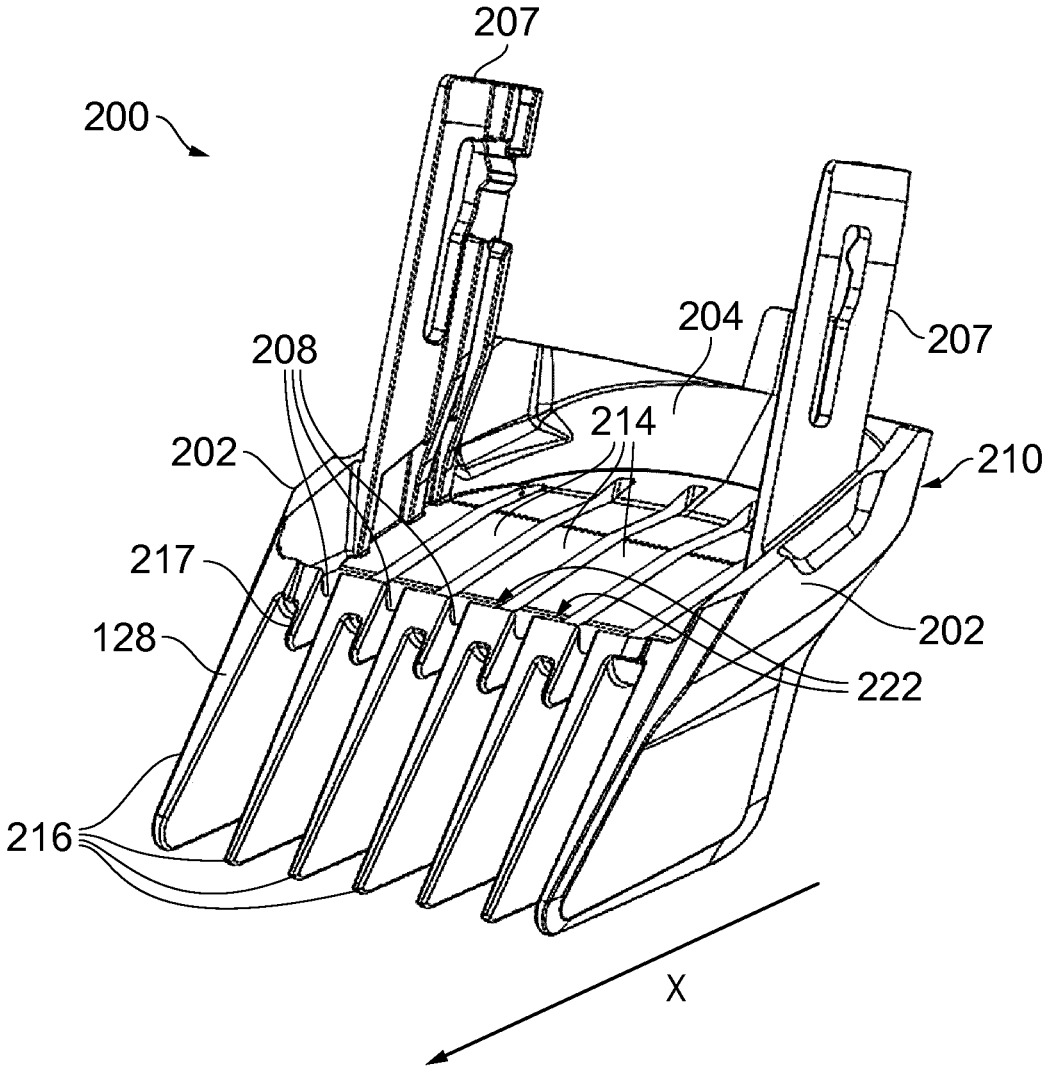
FIG. 2 is a is a perspective view of the comb of FIG. 1.

The apparatus 10 also comprises a comb 200, as best illustrated in FIG. 2. The comb 200 guides and lifts hairs to be cut so that the cutting element 106 can cut them effectively and efficiently.

The comb 200 comprises a support body 210 having two side elements 202. The two side elements 202 are connected together and spaced apart by a rear connecting bar 204. The distance between the side elements 202 (and the axial length of the connecting bar 204) is substantially equal to the width of the cutting head 104 of the clipper 100 such that the comb 200 can be mounted on the cutting head 104 between the frame elements 202.

A connection feature in the form of a rail 207 extends from each of the side elements 202 on the support body 210. The rails 207 are insertable into corresponding slots in the clipper 100 for attaching the comb 200 to the clipper.

The rear connecting bar 204 is formed at a rearward edge of the support body 210. A plurality of elongate strips 214 of the support body 210 extend forwardly from the rear connecting bar 204 in the cutting direction x. The plurality of strips 214 generally conform to the skin facing surface 126 of the clipper 100 such that, when the comb 200 is attached to the clipper 100, the strips 214 mate with the skin-facing surface 126.

The strips 214 curve at their forward end (i.e. furthest from the rear connecting bar 204 in the cutting direction x away from the skin surface) to define curved portions having rear facing edges 222 which face backwards in the cutting direction x. The rear facing edges 222 of the comb 200 and their corresponding strips 214 define a discontinuous shoulder 208 configured to extend around the cutting element 106 and cutting edge 117 of the clipper 100 when the comb 200 is connected thereto. Shoulder 208 is curved in FIG. 2 although it may instead be angular.

A pair of comb teeth 216, 217 extend from each respective strip 214. The comb 200 comprises a plurality of such pairs of comb teeth 216, 217 in side-by-side arrangement along a direction parallel to the cutting edge 117 shown in FIG. 1.

It will be appreciated that although the drawings show the pairs of comb teeth 216, 217 extending from the strips 214 of the support body 210, this is not required. In other arrangements the support body may not comprise a plurality of strips but may instead be a substantially continuous, e.g. planar, body having protrusions extending therefrom to form the plurality of pairs of comb teeth.

Each pair of comb teeth comprises a primary comb tooth 216 and a secondary comb tooth 217 arranged adjacent to the primary comb tooth 216 in a lateral direction parallel to the cutting edge 117.

The pairs of comb teeth 216, 217 generally extend longitudinally in parallel directions substantially perpendicularly to the cutting edge 117 away from the support body 210 and towards the surface of the skin on which hairs to be cut are located. The primary comb tooth 216 provides a predetermined fixed spacing between the skin of a user and the cutting element 106 in order to define a hair cutting length, i.e. the length of the hairs after cutting. The secondary comb teeth 217, however, do not meet the skin surface in use.

The comb teeth 216, 217 extend forward of the cutting element 106 and the housing 109 of the clipper 100 in the cutting direction x. In particular, each pair of comb teeth 216, 217 have a front face 128 that extends at an obtuse angle, $\Theta$, which is around 120 degrees, from a forward face of the cutting head 104 (as shown in FIG. 1). It can also be said that the front face 128 extends at an obtuse angle, around 120 degrees, from the skin surface, in use.

It will be appreciated that although FIG. 1 shows both primary and secondary comb teeth 216, 217 having a front face 128 that extends from a forward face of the cutting head 104 by a single angle, $\Theta$, this is not required. The primary comb teeth may have a front face that extends from the forward face of the cutting head 104 by a different angle to that of a front face of the secondary comb teeth.

Figure 4:
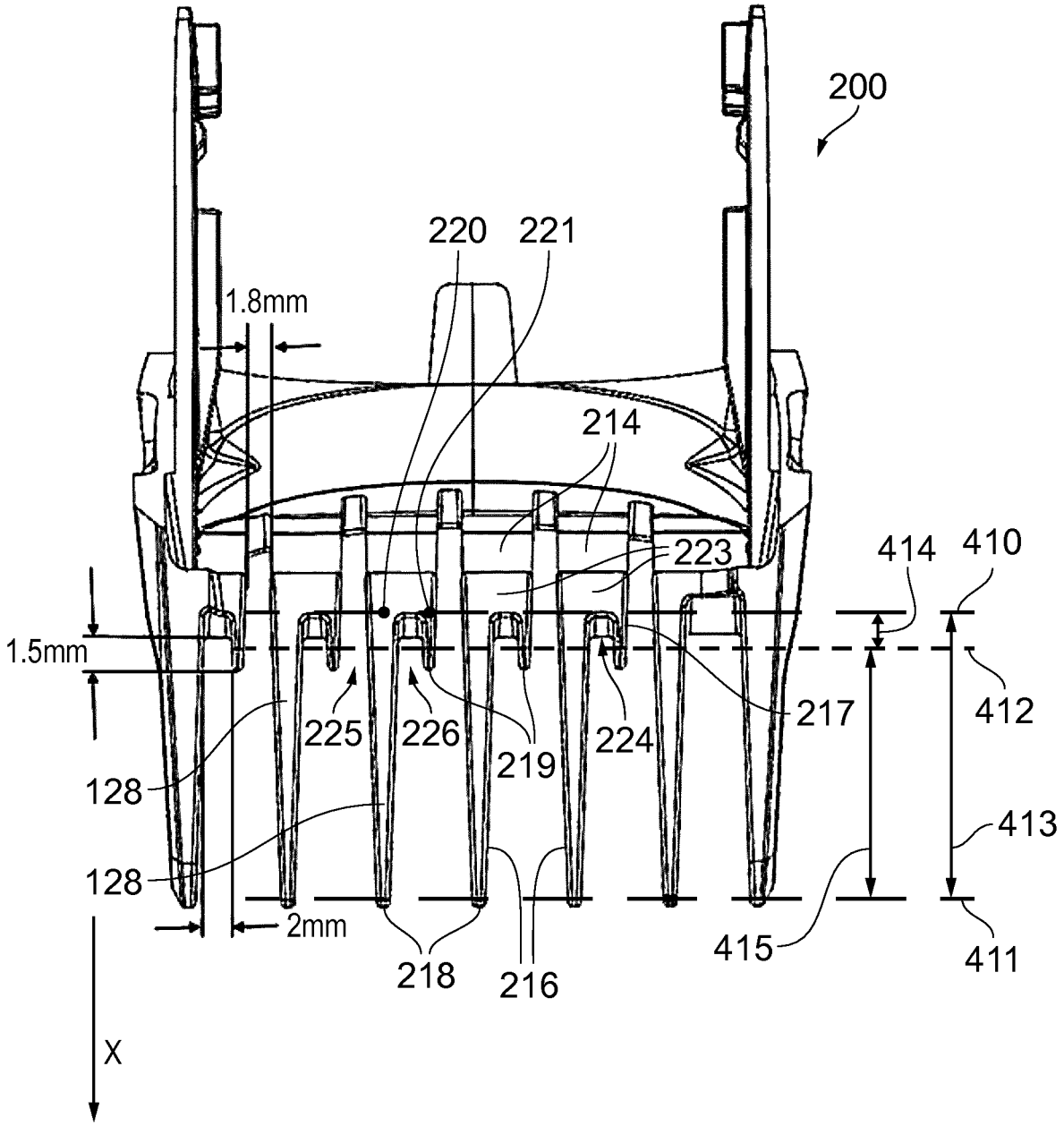
FIG. 4 is a front view of the comb of FIG. 2.

As best illustrated in FIG. 4, each primary comb tooth 216 has a longitudinal extent 413 (along the front face 128) from a root point 220 proximal the support body 210 to a distal primary tip 218 which is the forwardmost point of the primary comb tooth 216 in the cutting direction x. Each secondary comb tooth 217 has a longitudinal extent 414 (along the front face 128) from a root point 221 proximal the support body 210 to a distal secondary tip 219, which is the forwardmost point of the secondary comb tooth 217 in the cutting direction x.

It will be appreciated that roots 220, 221 are on the support body 210 at positions proximate the cutting element 106 of the clipper 100. In particular, roots 220, 221 are proximate the rear facing edges 222 of the comb 200 against which the cutting element 106 abuts when the comb 200 is attached to the clipper 100. The roots 220, 221 are the points on the support body 210, particularly the strip 214 in FIG. 4, from which the primary comb tooth 216 and secondary comb tooth 217 extend, respectively.

In this example, the roots 220, 221 have corresponding longitudinal positions in that they are at an equal distance from the cutting element 106 or edge 117. The primary comb tooth 216 has a greater longitudinal extent 413 than the longitudinal extent 414 of the secondary comb tooth 217. In this way, each pair of comb teeth 216, 217 is configured such that the distal primary tip 218 extends longitudinally beyond the distal secondary tip 219 of the pair. In other examples, however, the primary comb tooth 216 and the secondary comb tooth 217 may have equal longitudinal extents 413, 414, but the root 220 of the primary comb tooth 216 may be positioned longitudinally forward of the root 221 of the secondary comb tooth 217 in the cutting direction x such that the distal primary tip 218 extends longitudinally beyond the distal secondary tip 219.

The comb 200 also includes a blocking portion 223 which extends between the roots 220, 221 of the primary and secondary comb teeth 216, 217 of each pair. In this example, the blocking portion 223 corresponding to each pair is a part of the corresponding strip 214 and is integrally formed with the support body 210, primary tooth 216 and the secondary tooth 217 of the pair in question. However, in other examples these various portions may be separate components that couple together to form an equivalent configuration. As such the comb tooth 216, the secondary comb tooth 217 and the blocking portion 223 may be designed as separate elements that attach to a support body 210 or strip 214.

The blocking portion 223 connects the roots 220, 221 of the primary comb tooth 216 and the secondary comb tooth 217 to define a blocking channel 226 between the primary and secondary comb teeth 216, 217 of a pair which prevents hairs within the blocking channel 226 from reaching the cutting element 106 of the hair clipper 100. In the examples shown, the blocking portion 223 comprises a hair-facing edge 224 that is parallel to the cutting element 106 such that the primary comb tooth 216, the secondary comb tooth 217 and the hair-facing edge 224 of the blocking portion 233 together define an asymmetric U-shaped profile in cross-section.

Figure 3:
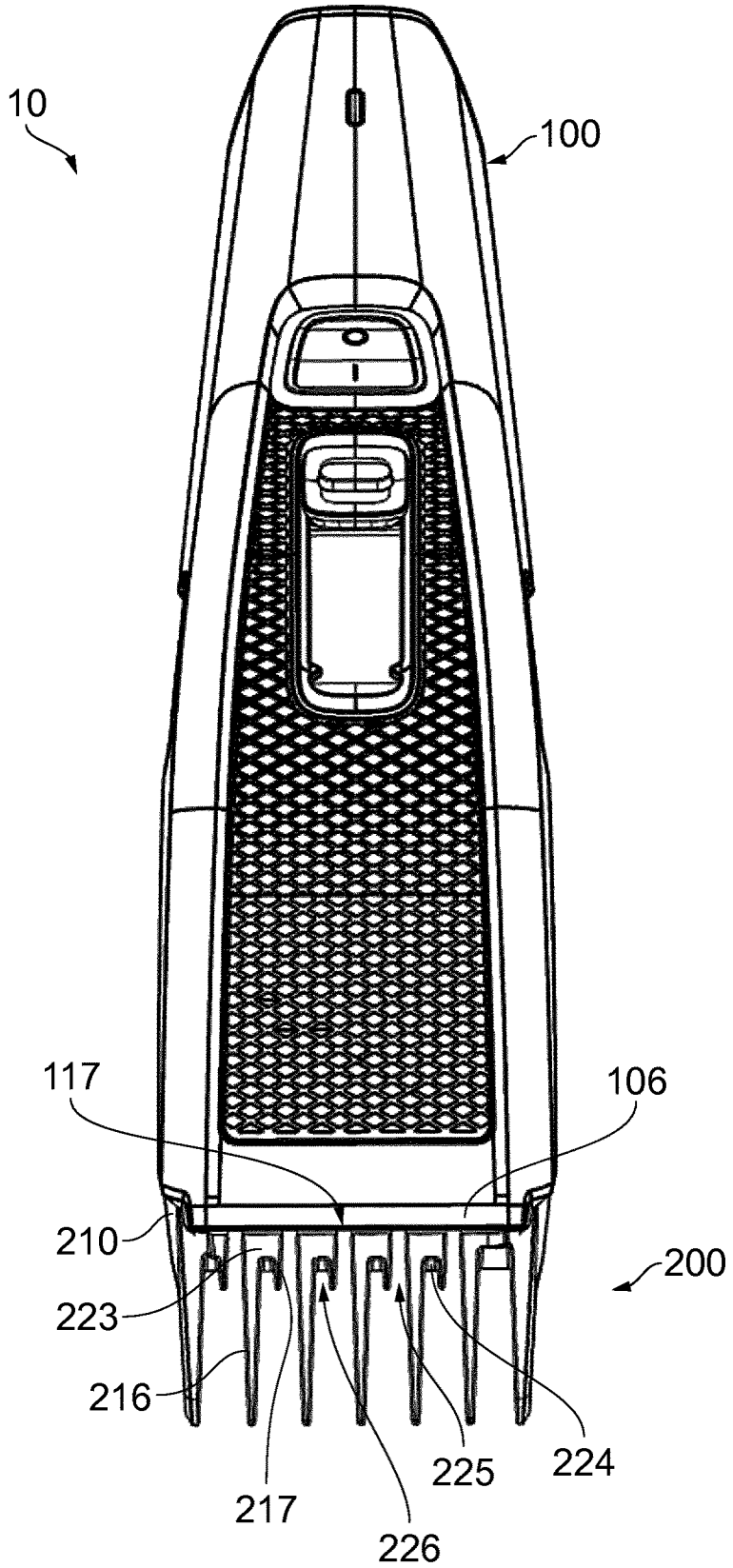
FIG. 3 is a front view of the hair clipper apparatus of FIG. 1.

As can be seen in FIGS. 3 and 4, adjacent pairs of comb teeth 216, 217 and adjacent blocking element 233 are separated by a cutting gap 225 to permit hair to pass through the gap 225 to the cutting element 106 of the clipper 100. In this way, only a portion of the hairs falling between adjacent pairs of comb teeth, in particular adjacent primary teeth 216, will be cut by the cutting element 106 in use. Accordingly, operating the clipper 100 with such a comb 200 attached thereto will effect hair-thinning, whereby some but not all of the hairs are cut to the desired length.

The specific dimensions of the plurality of pairs of comb teeth will now be described with respect to FIG. 4. However, it will be appreciated that the dimensions are given as examples only and that any suitable dimensions could be used in practice.

As can be seen, the primary comb teeth 216 of respective pairs of comb teeth have equal thickness. The secondary comb teeth 217 of respective pairs of comb teeth also have equal thickness. The primary and secondary comb teeth 216, 217 taper along their longitudinal extents such that their distal tips are narrower than their root portion.

The respective pairs of comb teeth 216, 217 are generally equally spaced across the width of the comb 200 along the lateral direction such that adjacent pairs of comb teeth 216, 217 are separated by equally sized cutting gaps 225. In the arrangement of FIG. 4, the pairs of comb teeth 216, 217 are of equivalent dimensions such that the pitch between adjacent primary teeth 216 are equal and the pitch between adjacent secondary teeth 217 are equal.

The width of the channels 226 between the primary and secondary comb teeth 216, 217 is of similar size to the width of the cutting gaps 225 such that the secondary comb tooth 217 is substantially in the centre of adjacent primary teeth 216. In this particular example, the blocking channels 226 of FIG. 4 are 1.8 mm wide, while the cutting gaps 225 are 2 mm wide. These widths allow approximately half of the hairs entering the comb between respective pairs of comb teeth 216, 217 to be blocked/cut during a single stroke, thereby resulting in an even hair thinning effect across the pairs of comb teeth.

The lateral pitch between a distal secondary tip 219 of a secondary tooth 217 and its adjacent primary tooth 216 is smaller than the pitch between adjacent primary teeth. In this way, hair entering the comb 200 between adjacent primary teeth 216 will be separated into narrower columns or bundles of hairs to be cut by the cutting element 106 and blocked by the blocking channel 226. This has the effect of providing a finer hair-thinning result which will increase the blending of the hair between shorter and longer strands. This is in contrast to hypothetical arrangements where a blocking portion occupies the entire region between selected pairs of adjacent primary comb teeth, which would result in visibly staggered and clashing hair lengths due to having wider columns of hairs that are blocked by a blocking element and hairs that are cut by a cutting element.

In this regard, it will be appreciated that as a result of the (tapered) primary comb teeth 216 extending longitudinally beyond the (tapered) secondary comb teeth 217, the secondary comb teeth 217 are narrower in width (in the lateral direction) than the primary comb teeth 216, at the same distance from the cutting element 106 or edge 117. In this way, a smaller lateral separation between all separation points in the comb 200 (the tips of all of the comb teeth) can be achieved, thereby providing a more blended hair-thinning result in use, while still being able to manufacture an adequately sized blocking channel 226 and cutting gap 225. Further, having secondary comb teeth which are narrower than the primary comb teeth facilitates easier manufacture of the overall comb structure. This is compared to the manufacture of hypothetical comb structures having the same separation between all separation points, but equally wide comb teeth at the same distance from a cutting element.

In this example, the distal primary tip 218 extends longitudinally beyond the distal secondary tip 219 by a length 415 that is approximately seven times the longitudinal extent 414 of the secondary comb tooth 217. The length between the primary comb teeth 216 and the secondary comb teeth 217 allows the primary comb teeth 216 to effectively raise and guide hairs in a first separation stage, to reach a desirable orientation for separation by the secondary comb teeth 217 in a second separation stage, as will be described further below.

The longitudinal extent 414 of each secondary comb tooth 217 from a root 221 proximal the support body 210 to a distal secondary tip 219 is approximately 1.5 mm in length.

In use the primary comb teeth 216 separate hair in a first separation stage and the secondary comb teeth 217 separate hair received between the primary comb teeth 216 between the blocking channel 226 and the cutting gap 225 in a second separation stage. This function of the comb 200 will now be described in detail with respect to FIGS. 5*a* and 5*b*.

Figure 5:
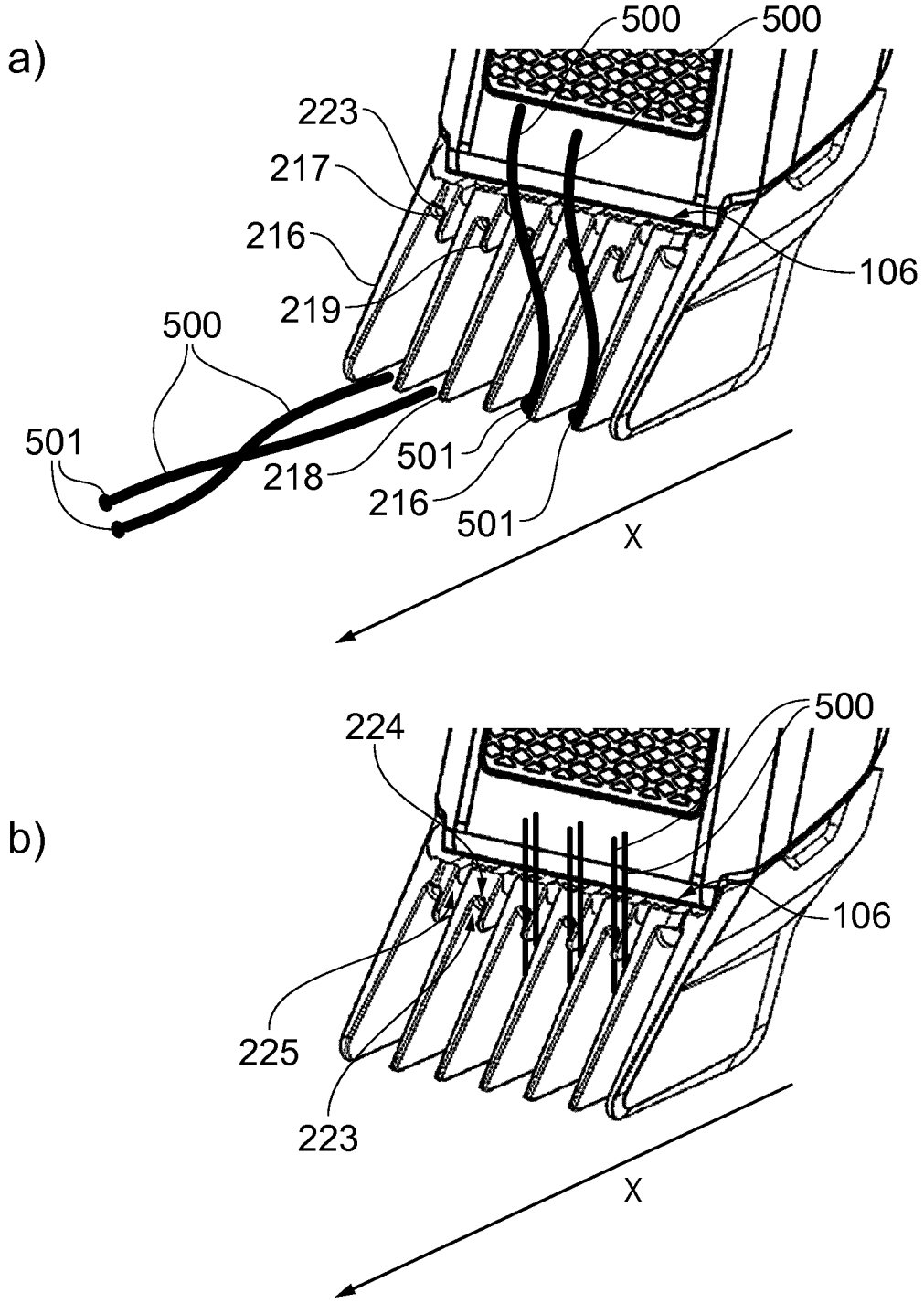
FIG. 5*a* is a perspective view of the hair clipper apparatus of FIG. 1 in use.
FIG. 5*b* is a perspective view of the hair clipper apparatus of FIG. 1 in use.

As the apparatus 10 is moved in the cutting direction x, hairs 500 are brought towards the comb 200 to be thinned. As can be seen in FIG. 5*a*, in an example the hairs 500 are tangled and orientated randomly from their roots 501 on the surface of the skin (not shown).

Tangled hairs 500 having roots 501 positioned at either side of a given primary comb tooth 216 are untangled by the primary comb tooth 216 in a first separation stage. Further, any hairs having roots positioned between a pair of adjacent primary comb teeth 216 enter the comb 200 and are separated from hairs having roots positioned between a different pair of adjacent primary comb teeth 216.

Although FIGS. 5*a* and 5*b* show only a limited number of hairs 500 entering the comb 200, it will be appreciated hairs are not prohibited from entering the comb 200 between the primary comb teeth 216 because the only obstructions between primary comb teeth 216 are the hair facing edges 224 of the blocking portions, which are downstream of the distal primary tips 218 of the primary comb teeth 216. This has the effect of maximising the number of hairs 500 that enter the comb 200, which in turn increases the hair-thinning effect per stroke.

After the hairs 500 have been separated in the first separation stage, the primary comb teeth 216 engage the hair 500 such that the hair 500 is lifted and guided towards the secondary comb teeth 217 downstream of the primary comb teeth 216. As the distal primary tips 218 extend longitudinally beyond the distal secondary tips 219 in the cutting direction x, the hair 500 is adequately manipulated (raised and guided) by the primary comb teeth 216 to a desired orientation for subsequent separation between hairs 500 to be cut by the cutting element 106 and hairs 500 to be blocked by the blocking channel 226, by the secondary comb teeth 217. For example, it can be seen schematically in FIG. 5*b* that the hairs 500 are brought uniformly towards the secondary comb teeth 217 so that the hairs 500 can be effectively separated by the secondary comb teeth 217 in the second separation stage.

In the secondary separation stage, the secondary comb teeth 217 not only separate hairs 500 between those to be cut and those to be blocked, but also comb the hairs passing thereby. That is, tangled hairs having roots with positions corresponding to either side of a given secondary comb tooth 217 are untangled by the secondary comb tooth 217 in the second separation stage. Thus it can be said that the primary comb teeth 216 form a coarse comb while the secondary comb teeth 217 form a finer comb downstream of the first comb to further untangle hairs.

Further untangling hairs 500 in the second separation stage subsequent to and downstream of the first separation stage has the effect of increasing the uniformity of the hairs 500 to be cut by the cutting element 106. This ensures that a larger number of hairs 500 in the cutting gap are cut correctly to the fixed cutting length.

In addition to the above, the secondary comb tooth 217 of each pair of comb teeth 216, 217 defines a wall of the blocking channel 223 which provides a barrier to prevent hairs 500 aligned with the hair-facing edge 224 of the blocking portion from slipping in a direction parallel to the cutting edge 117 towards the cutting gap 225. This decreases the number of stray hairs that inadvertently fall into the cutting gap 225 and are undesirably cut by the cutting element 106 despite having root positions that correspond to and are aligned with the blocking portion. This increases the consistency of the thinning result for different strokes through the hair.

Accordingly, the example comb 200 described herein serves not only to increase the thinning effect per stroke by allowing a maximum number of hairs to enter the comb, but also to provide a more consistent thinning result per stroke by better orientating the hairs for the separation between those to be cut or blocked and for the cutting itself. The comb described herein also provides a more blended thinning result by providing narrower channels of hair that are blocked and cut, respectively.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A hair-thinning comb comprising:
a support body for attachment to a hair clipper;
a plurality of pairs of comb teeth in side-by-side relationship, wherein each pair of comb teeth comprises:
a primary comb tooth having a longitudinal extent from a root proximal the support body to a distal primary tip;
a secondary comb tooth adjacent to the primary comb tooth, and having a longitudinal extent from a root proximal the support body to a distal secondary tip;
wherein the distal primary tip extends longitudinally beyond the distal secondary tip;
wherein there is a blocking portion between the roots of the primary and secondary comb teeth configured to prevent any hairs received in a blocking channel defined between the primary and secondary comb teeth from reaching a cutting element of the hair clipper; and
wherein adjacent pairs of comb teeth are separated by a cutting gap to permit hair to pass through the cutting gap to a cutting element of a hair clipper;
whereby in use the distal primary tips separate hair in a first separation stage, and the distal secondary tips separate hair received between the primary comb teeth between the blocking channel and the cutting gap in a second separation stage.

2. The hair-thinning comb as claimed in claim 1, wherein the longitudinal extent of the primary comb tooth is greater than the longitudinal extent of the secondary comb tooth.

3. The hair-thinning comb as claimed in claim 1, wherein the blocking portion connects the roots of the primary comb tooth and the secondary comb tooth to define the blocking channel.

4. The hair-thinning comb as claimed in claim 1, wherein the blocking portion comprises a hair-facing edge that is parallel with a lateral direction along which the pairs of comb teeth are spaced apart.

5. The hair-thinning comb as claimed in claim 4, wherein the primary comb tooth, the secondary comb tooth and the hair-facing edge define an asymmetric U-shaped profile in cross-section.

6. The hair-thinning comb as claimed in claim 1, wherein the primary comb tooth provides, at least in part, a predetermined fixed spacing between a skin of a user and the cutting element in order to define a hair cutting length.

7. The hair-thinning comb as claimed in claim 1, wherein a pitch between the distal secondary tip and an adjacent primary comb tooth in a direction parallel with a lateral direction along which the pairs of comb teeth are spaced apart is in the range of 1-3 mm.

8. A hair clipper apparatus comprising:
a hair clipper having a housing and a cutting element; and
a hair-thinning comb as claimed in claim 1.

* * * * *